United States Patent [19]

Tsukada et al.

[11] 4,447,163

[45] May 8, 1984

[54] STEM MECHANISM FOR A WATCH

[75] Inventors: Nobuo Tsukada; Isamu Nishida, both of Tokyo, Japan

[73] Assignee: Seiko Instruments & Electronics Ltd., Tokyo, Japan

[21] Appl. No.: 338,236

[22] Filed: Jan. 11, 1982

[30] Foreign Application Priority Data

Jan. 23, 1981 [JP] Japan ..... 56-9190

[51] Int. Cl.[3] ..... G04B 27/04; G04B 27/02; G04B 19/22; G04C 3/00

[52] U.S. Cl. ..... 368/319; 368/191; 368/192

[58] Field of Search ..... 368/185, 190, 191, 192, 368/193, 194, 195, 308, 319

[56] References Cited

U.S. PATENT DOCUMENTS 3,756,015 9/1973 Saito et al. ..... 368/192 X
3,762,153 10/1973 Komiyama et al. ..... 368/192 X
3,837,162 9/1974 Meitinger ..... 368/192 X
4,274,152 6/1981 Ikegami ..... 368/191 X

*Primary Examiner*—J. V. Truhe
*Assistant Examiner*—Terry Flower
*Attorney, Agent, or Firm*—Robert E. Burns; Emmanuel J. Lobato; Bruce L. Adams

[57] ABSTRACT

A winding stem mechanism for a watch having a winding stem and a pinion with a shaft body. The winding stem and pinion are dimensioned to slidably fit within a base plate recess, and have respective facing ends. One facing end is provided with a square blind bore, and the other facing end is square and complementary to the blind bore and dimensioned to slidably fit within the blind bore so that the winding stem can slide away from the pinion without displacing same and the winding stem can slide toward the pinion and displace same in the direction of travel of the winding stem. The pinion engages a setting wheel for setting a wheel train.

6 Claims, 8 Drawing Figures

STEM MECHANISM FOR A WATCH

BACKGROUND OF THE INVENTION

The present invention relates to a stem mechanism, and more particularly to a stem machanism for a watch of exceedingly thin size to eliminate the overall watch thickness.

In the conventional type stem mechanism for a watch, the intermediate portion of the winding stem has a square section to engage with the sliding pinion, whereby the stem and the sliding pinion overlap planly and the stem mechanism has the thickness of the stem plus the sliding pinion. As the result, a wheel train turned by the stem and the sliding pinion is inevitably arranged to add to the thickness of the timepiece.

SUMMARY OF THE INVENTION

The present invention aims to eliminate the above-noted difficulty and insufficiency, and therefore it is the object of the present invention to arrange the stem and the sliding pinion in the direction of the winding shaft, and to connect the stem to the sliding pinion at each opposed face thereof, one of which has a square hole extending in the direction of the winding shaft and the other of which has a square rod to join the square hole. In this case the outer diameter of the stem and that of the sliding pinion are substantially the same, whereby reduction of the thickness of a watch is attained.

Another object of the present invention is to position the setting lever, the yoke and the wheel train setting lever accurately by the arrangement of the stem and the sliding pinion.

Another object of the present invention is to eliminate the thickness of the correction wheel operated by the stem.

DETAILED DESCRIPTION OF THE INVENTION

Figure 1:
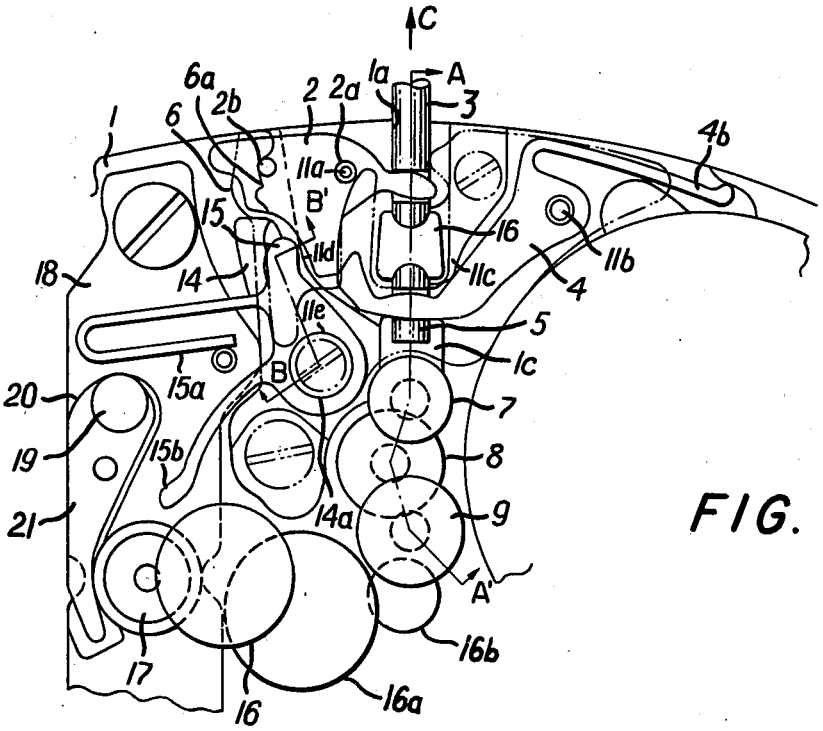
FIG. 1 shows a plan view of a hand adjusting portion, a wheel train and the like of the present invention.
Figure 2:
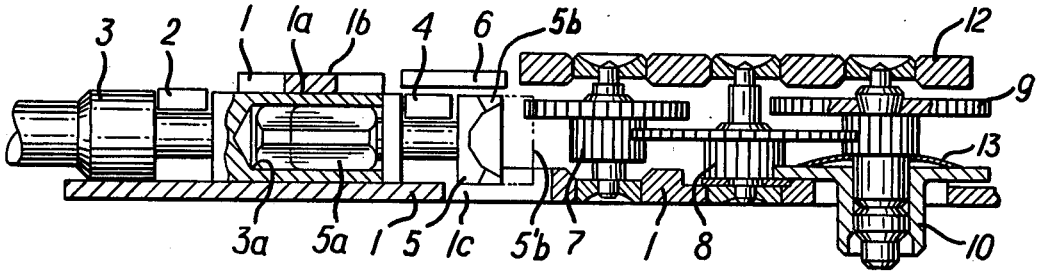
FIG. 2 shows a sectional view taken on line A—A' of FIG. 1.

FIG. 1 shows a plan view of a stem mechanism of the present invention, FIG. 2 shows a sectional view taken on line A—A' of FIG. 1, and FIGS. 3 to 8 show enlarged views of the elements shown in FIGS. 1 and 2. In the figures, reference numeral 1 denotes a main plate provided with a recess 1*a* formed from the outside to the center of the main plate 1 to mount a winding stem 3, and a center opening of the recess 1*a* is choked to restrict the vertical movement of the stem 3. The stem 3 is mounted on the recess 1*a* slidably and rotatably, and the stem 3 is provided with a blind square hole 3*a* at one end thereof, and vertical movement of the outer periphery of the stem end having the square hole 3*a* is restricted by a choking portion 1*b* at the middle of the recess 1*a* of the main plate 1. The stem 3 is provided with a recess to engage with a setting lever 2 at the base portion (outer periphery portion of the main plate) thereof.

Numeral 5 denotes a sliding pinion arranged at the end portion of the stem. The sliding pinion 5 is mounted in a relief hole 1*c* provided on the main plate 1 so that it is positioned on the same shaft as the stem. The sliding pinion 5 is provided at one end with a square rod shaft 5*a*. The square rod shaft 5*a* is of the same shape as the square hole of the stem 3, and slidably engages with the square hole 3*a* so that the sliding pinion 5 can be rotated by the rotation of the stem, and a yoke 4 slides the sliding pinion 5 in response to the movement of the stem and the setting lever.

Numeral 6 denotes a yoke holder to position the setting lever 2. The sliding pinion 5 is provided with teeth 5*b* to transmit the rotation of the stem 3 for effecting a hand adjustment. When the position of the hand is to be adjusted, the sliding pinion 5 is moved to a position 5'*b* shown by the two dot chain line in FIG. 2 by the operation of the yoke 4 and engaged with a setting wheel 7. The rotational force which is manually applied through the winding stem 3 is transmitted to the sliding pinion 5, the setting wheel 7, a minute wheel 8, a cannon pinion with driver 9 and an hour wheel 10, whereby the time is corrected. Numeral 12 denotes a bridge member to support the shafts of the setting wheel 7, the minute wheel 8 and the cannon pinion with driver 9. Numeral 13 denotes a dial washer provided between the cannon pinion with driver 9 and the hour wheel 10.

The stem 3 joins with the setting lever 2 having a hole portion 2*a* which engages with a pin 11*a* mounted on the main plate 1. The setting lever 2 is provided with a pin 2*b* which engages with an angle portion 6*a* of the yoke holder 6 to position the setting lever 2. The yoke 4 is provided with a hole portion 4*a* which joins with a pin 11*b* mounted on the main plate 1 and a spring portion 4*b* which is positioned by making contact with a step portion 11*c* of the base plate 1. When the yoke 4 contacts the step portion 11*c* of the main plate 1, the sliding pinion 5 does not engage with the setting wheel 7 by the yoke 4 as shown in FIG. 1. A pin 11*e* mounted on the main plate extends into a center hole portion 14*a* of the wheel train setting lever 14 which is in one body with a member 15 having spring portions 15*a* and 15*b*, and the wheel train setting lever 14 is positioned to contact a step portion 11*d* of the main plate by the spring action of the spring portion 15*b*.

A rotor 17 is driven by a magnetic circuit comprised of a coil block (not shown) and a stator 18 when the coil block is magnetized, and the power is transmitted to the wheel train via a wheel 16 and idler wheels 16*a* and 16*b*. A reset pin 19 is mounted on an insulating plate together with a reset lead terminal 21, and electrical insulation between the reset pin and the stator 18 is held by way of an insulating member (not shown).

Figure 3:
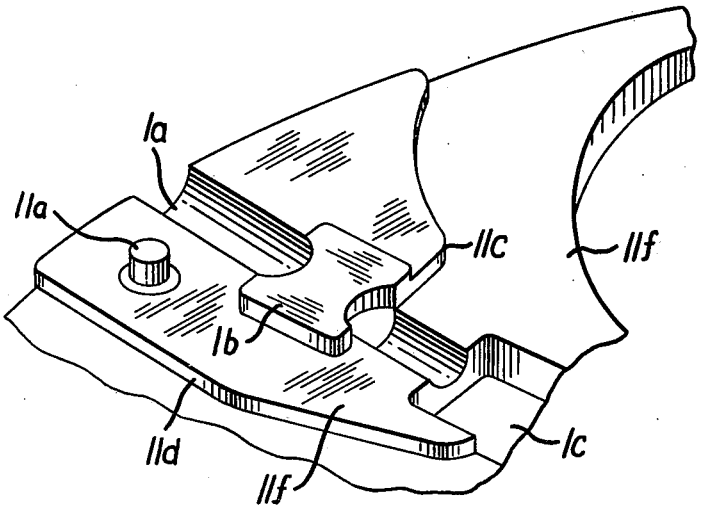
FIG. 3 shows a fragmentary enlarged perspective view of a main plate.

FIG. 3 shows a fragmentary enlarged perspective view of the main plate 1, in which 11*f* denotes a pedestal to mount the yoke 4 and 11*c* denotes a step portion which the yoke contacts. 11*d* denotes a step portion which the wheel train setting lever 14 contacts, and 1*a* denotes the lateral recess to mount the stem 3.

Figure 4:
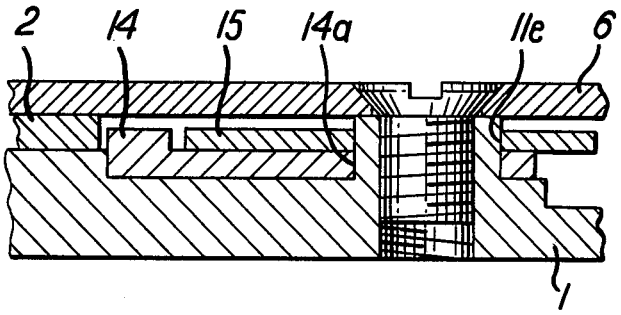
FIG. 4 shows a sectional view taken on line B—B' of FIG. 2.

FIG. 4 shows an enlarged sectional view taken on line B—B' of FIG. 1, in which the train wheel setting lever 14 contacts the step portion 11*d* of the main plate.

Figure 5:
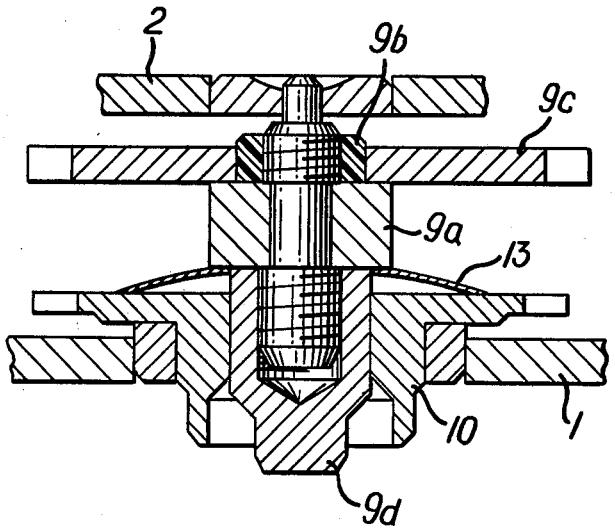
FIG. 5 shows an enlarged sectional view of a cannon pinion with driver and an hour wheel.
Figure 6:
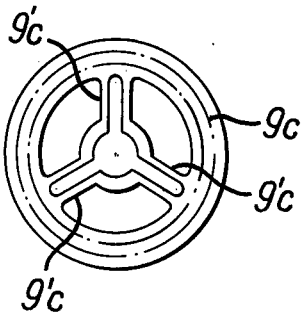
FIG. 6 shows a plan view of a minute gear of a cannon pinion with driver.

FIGS. 5 and 6 shows the structure of the cannon pinion with driver corrected and actuated by the stem and the sliding pinion. The cannon pinion with driver 9 is comprised of a pinion portion 9*a*, a minute gear 9*c*, a minute gear bushing 9*b* and a cannon portion 9*d*. The minute gear 9*c* is provided with a spring portion 9'*c* as shown in FIG. 6 to be slipped in case of hand adjustment.

Figure 7:
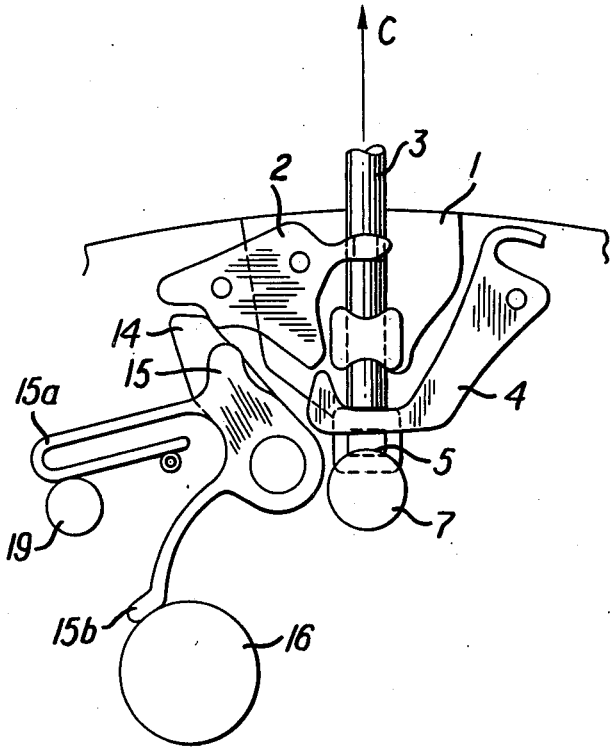
FIG. 7 shows a plan view of an operation of a stem mechanism according to the present invention.

The operation of the stem mechanism of the present invention will be illustrated in conjunction with FIG. 7.

If the stem 3 is extracted and pulled outwardly in the direction of the arrow mark C, the setting lever 2 operates to pivot the wheel train setting lever 14. The spring portion 15*b* of the member 15, which is a one-piece structure with the wheel train setting lever 14, engages with and stops the wheel 16. Simultaneously the other spring 15*a* contacts the reset pin 19 and the reset switch in the electronic circuit not shown is switched on. When the stem 3 is then rotated, the square hole portion 3*a* of the stem is joined with the square rod portion 5*a* of the sliding pinion 5, and the sliding pinion 5 is also rotated. And then power is transmitted to the setting wheel 7, the minute wheel 8, the hour wheel 10 and the cannon pinion with driver 9, whereby the time is corrected.

Figure 8:
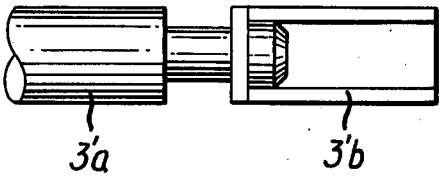
FIG. 8 shows another embodiment of a winding stem according to the present invention.

As illustrated so far, according to the present invention, the stem, the sliding pinion and the yoke do not overlap each other, so that the sectional dimension is reduced without reducing the strength of each part. Since the lateral hole for holding the stem end is not necessary, the degree of freedom to position the section of the transmission wheel for time correction increases, whereby the movement can be made thin. The stem is directly held in the lateral hole of the main plate at the outer periphery of the square hole portion not through the sliding pinion, so that lateral pressure is not applied to the sliding pinion, and the sliding pinion is operated stably. Since the square hole portion of the stem is guided by the lateral hole of the main plate, the stem is smoothly inserted in the main plate on the same shaft as the sliding pinion. The square hole portion of the stem end of the present invention may be the sliding pinion having a blind square hole made in one body with the stem as shown in FIG. 1, or the square hole portion may be the compound parts including a pipe 3*b* having a square hole driven into a stem body 3*a* as shown in FIG. 8. If the stem is made of stainless steel of inferior machinability for improving the corrosion resistance, the square hole of the pipe is made of a material of excellent machinability, whereby this structure is exceedingly advantageous for manufacture.

Further, in the conventional type, the wheel train setting lever is comprised of the spring portion and the bridge portion made of the same material in one body, so that it is difficult that the spring has the sufficient effective length in the case the space is limited such as is a small timepiece. On the contrary, the spring portion and the bridge portion of the train sheel setting lever are made separately in the present invention, so that the stress correspondence of the spring can be freely chosen.

Although the winding stem is actuated by pushing the setting lever during the hand stepping condition, the wheel train is not effected in the structure of the present invention, since the wheel train setting lever and the yoke are positioned securely by contacting them to the main plate as shown in FIG. 2.

Since the minute gear of the cannon pinion with driver is mounted on the cannon pinion by way of the bushing, the bottom of the teeth of the cannon pinion does not interfere with the minute gear. Consequently the module of the cannon pinion can be extensively minimized, the battery can be arranged at the center of the movement, and the movement can be minimized.

As illustrated so far, the present invention is very effective.

We claim:

1. A winding stem mechanism for a watch comprising: a winding stem axially displaceable to a plurality of positions for setting a wheel train, for switching a reset switch, and for correcting a time, a slidable pinion slidably and rotatably mounted on a center line of the winding stem, one of the stem and pinion having a square hole extending axially in the direction of the winding stem and the other having a square rod which slidably engages with the square hole so that rotational movement of the winding stem is transmitted to the pinion, and wherein the outer diameter of the stem is substantially the same as that of the pinion.

2. A winding stem mechanism for a watch comprising: a winding stem axially displaceable from a normal rest position to a plurality of positions for setting a wheel train, for switching a reset switch, and for correcting a time, a slidable pinion slidably and rotatably mounted on a center line of the winding stem, one of the stem and pinion having a square hole extending axially in the direction of the winding stem and the other having a square rod which slidably engages with the square hole so that rotational movement of the winding stem is transmitted to the pinion, a resilient yoke engaged with the pinion and a resilient wheel train setting lever interlocked with a setting lever and in contact with and positioned by a step portion of a main plate without interference from the setting lever when the stem is not displaced from its normal rest position.

3. A winding stem mechanism for a watch as claimed in claim 2, wherein said wheel train setting lever and a circuit reset position are made of non-magnetic materials and mounted on an upper surface of a stator.

4. A winding stem mechanism for a watch comprising: a winding stem axially displaceable to a plurality of positions for setting a wheel train, for switching a reset switch, and for correcting a time, a slidable pinion slidably and rotatably mounted on a center line of the winding stem, one of the stem and pinion having a square hole extending axially in the direction of the winding stem and the other having a square rod which slidably engages with the square hole, the outer diameter of the stem being substantially the same as that of the pinion, said pinion engaging with a cannon pinion with driver by way of a setting wheel and a minute wheel for correcting time when the stem is extracted from a normal position and displaced to one of the plural positions, one end of the shaft of the cannon pinion with driver being supported by a bridge member and the other end thereof being supported by a main plate by way of a supporting member which supports an inner diametrical surface and outer periphery of an hour wheel, and the distance between the cannon pinion with driver and the hour wheel being substantially the same as the diameter of the stem.

5. A winding stem mechanism for a watch, comprising: a base plate having a longitudinal recess; a winding stem rotatably and slidably disposed within the base plate recess to enable said winding stem to rotate therein and to be axially displaced to different positions along the length of the recess; a pinion having a shaft body slidably and rotatably mounted within the base plate recess to permit said pinion shaft body to rotate therein and to be axially displaced to different positions along the length of the recess, said pinion being positioned at one end of said pinion shaft body remote from said winding stem; said winding stem and said pinion shaft body having facing ends, a respective one of said facing ends having a square blind bore and the other of said facing ends having a square shape complementary to that of said blind pore, the square shape being slidably disposed within the square blind bore to enable the winding stem to slide relative to the pinion and to enable rotational movement of the winding stem to be transmitted to the pinion; and wherein the outer diameter of said winding stem is substantially the same as the outer diameter of said pinion.

6. A winding stem mechanism for a watch, according to claim 5, further comprising a wheel train; a wheel train setting lever engaged by said winding stem and positioned to engage said wheel train to prevent rotation of said wheel train when said winding stem is displaced in a direction away from said pinion; and a setting wheel engaged with said wheel train and positioned facing said pinion to be engaged by said pinion for setting said wheel train when said winding stem is displaced in a direction toward said pinion and said facing ends engage.

* * * * *